US006564569B1

(12) United States Patent
Havens

(10) Patent No.: US 6,564,569 B1
(45) Date of Patent: May 20, 2003

(54) REFRIGERATION SYSTEM FOR COMMERCIAL FOOD HANDLING

(76) Inventor: Brian D. Havens, 10913 Larson Dr., Northglenn, CO (US) 80223

( * ) Notice: Subject to any disclaimer, the term of this patent is extended or adjusted under 35 U.S.C. 154(b) by 126 days.

(21) Appl. No.: 09/668,774

(22) Filed: Sep. 22, 2000

(51) Int. Cl.[7] ..... F25D 23/12
(52) U.S. Cl. ..... 62/258; 62/414; 62/256
(58) Field of Search ..... 62/258, 414, 419, 62/426, 256

(56) References Cited

U.S. PATENT DOCUMENTS

| | | | | |
|---|---|---|---|---|
| 2,243,958 A | | 6/1941 | Hermann | 62/89.5 |
| 2,262,104 A | | 11/1941 | Lambrecht et al. | 62/37 |
| 2,863,302 A | | 12/1958 | Morris | 62/256 |
| 4,685,311 A | | 8/1987 | Rastelli | 62/258 |
| 5,117,649 A | | 6/1992 | Mangini et al. | 62/251 |
| 5,168,719 A | | 12/1992 | Branz et al. | 62/258 |
| 5,182,924 A | | 2/1993 | Trulaske, Sr. | 62/255 |
| 5,191,769 A | | 3/1993 | Mangini et al. | 62/258 |
| 5,282,367 A | | 2/1994 | Moore et al. | 62/256 |
| 5,317,881 A | | 6/1994 | Colvin | 62/209 |
| 5,355,687 A | | 10/1994 | Carpenter et al. | 62/258 |
| 5,363,672 A | | 11/1994 | Moore et al. | 62/258 |
| 5,477,702 A | | 12/1995 | Kennedy et al. | 62/256 |
| 5,491,980 A | * | 2/1996 | Yingst et al. | 62/258 |
| 6,089,036 A | * | 7/2000 | Carlson et al. | 62/258 |
| 6,151,905 A | * | 11/2000 | Smith | 62/258 |

* cited by examiner

*Primary Examiner*—William E. Tapolcai
(74) *Attorney, Agent, or Firm*—John E. Reilly

(57) ABSTRACT

A refrigerated food preparation apparatus is made up of a cabinet having storage compartments therein and an upper sloped food handling table with a recessed portion for food container inserts having upwardly open ends to facilitate convenient access to food placed in the inserts, a supply air duct and return air duct extending along opposite sides of the food container inserts, and a refrigeration system for directing air from an evaporator section for discharge simultaneously and in separate layers across the food container inserts.

13 Claims, 6 Drawing Sheets

REFRIGERATION SYSTEM FOR COMMERCIAL FOOD HANDLING

BACKGROUND AND FIELD OF INVENTION

This invention relates to refrigeration systems and more particularly relates to a novel and improved commercial food handling system for maintaining food that is in the process of preparation in the kitchen at a controlled temperature.

There are currently refrigerator systems intended for commercial kitchen preparation which essentially consist of an outer housing or enclosure with inner compartments in some form of refrigerant apparatus as employed in the standard refrigerator so that containers of food may be placed into the compartments and removed only when needed for preparing different dishes. Other commercial food handling units have been devised in which certain foods, such as, salad makings as well as dressing can be placed in food containers and left exposed while cooling the undersides of the containers. Representative of such systems are set forth and described in U.S. Pat. No. 5,477,702 to Kennedy, C. L. et al, U.S. Pat. No. 5,363,672 to Moore, E. et al, U.S. Pat. No. 5,355,687 to Carpenter, D. et al, U.S. Pat. No. 5,317,881 to Colvin, L. F., U.S. Pat. No. 5,282,367 to Moore, E. et al, U.S. Pat. No. 5,191,769 to Mangini, D. J. et al, U.S. Pat. No. 5,182,924 to Trulaske, R. J., Sr., U.S. Pat. No. 5,168,719 to Branz, M. A. et al, U.S. Pat. No. 5,117,649 to Mangini, D. et al, U.S. Pat. No. 4,685,311 to Rastelli, A. A., U.S. Pat. No. 2,863,302 to Morris, H. A., U.S. Pat. No. 2,262,104 to Lambrecht, A. et al and U.S. Pat. No. 2,243,958 to Hermann, E. J.

There is a continuing need for refrigerant systems of the type described that are capable of providing immediate cooling uniformly throughout the individual food containers whether such containers are maintained in inner compartments or left at least partially exposed and in particular is capable of passing coolant air across the upper open ends of the food containers while the containers remain exposed and accessible to the chefs to accelerate preparation of individual servings.

SUMMARY OF THE INVENTION

It is therefore an object of the present invention to provide for a novel and improved refrigerant system for commercial food handling which is extremely reliable and efficient in use.

It is another object of the present invention to provide for a food handling system wherein a controlled circulation of coolant air will maintain both the inner compartments and exposed food containers at a preselected temperature and at the same time prevent contact with the food by flying insects.

It is a further object of the present invention to provide for a novel and improved refrigerated food handling cabinet containing a unique air circulating system for maintaining both internal and external food containers at a uniform temperature.

It is a still further object of the present invention to provide for a novel and improved food handling table adapted to receive food containers containing perishable food and for maintaining uniform circulation of air above and below the food containers to maintain a predetermined temperature level, discourage intrusion of bugs or insects but at that same time establish easy access to the food for preparation of individual servings.

In accordance with the present invention, there has been devised a novel and improved refrigerated food handling table of the type including a cabinet provided with a storage compartment for foods and a recessed portion in the horizontal top surface having a plurality of food container openings therein for supporting food containers above said storage compartment so as to be upwardly open with their bottom portions disposed in open communication with the storage compartment and which is characterized in particular by a supply air duct and return air duct disposed in spaced confronting relation to one another along opposite sides of the food containers and a refrigeration system in said cabinet including a condensor and first air flow means for directing outside air across the condensor, a compressor, and an evaporator including second air flow means for directing air across the evaporator for discharge in separate layers across and above each of the food containers.

The food containers are preferably aligned or oriented in a row or rows on the top surface of the cabinet and the supply air and return air ducts are preferably configured such that one extends higher than the other and are joined by sloped end panels at opposite ends of the food containers. In this way, the food containers are readily accessible to food handlers from the side of the table having the lowermost of the air ducts and the lower return air ducts will better take into account the effect of gravity on the air flowing over the top surface. Further, the supply and return air ducts are positioned with respect to the food containers such that air can be circulated in separate layers both above the food containers and across the lower portions of the food containers extending beneath the top surface of the table to maintain uniform temperature throughout each of the containers. At the same time, the air current generated across the top surface is such that insects are effectively precluded from contacting the exposed food in the containers. Most desirably, the supply air duct has a progressively reduced chamber area away from the air inlet and extending across one side of the food containers so as to promote uniform circulation of air across all of the food containers; and the return air duct similarly includes a chamber of progressively reduced area across its length to cooperate with the supply air duct in promoting uniform air circulation.

A unique air duct system for recirculating air enables the division of air into different streams not only across the food containers in the top surface of the table but across the lower compartments in the interior of the cabinet, and the air streams are recombined into a single return air stream which is induced to flow across the evaporator for recooling and recirculation back through the supply air duct to achieve maximum efficiency in cooling and distribution of the air throughout the cabinet.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
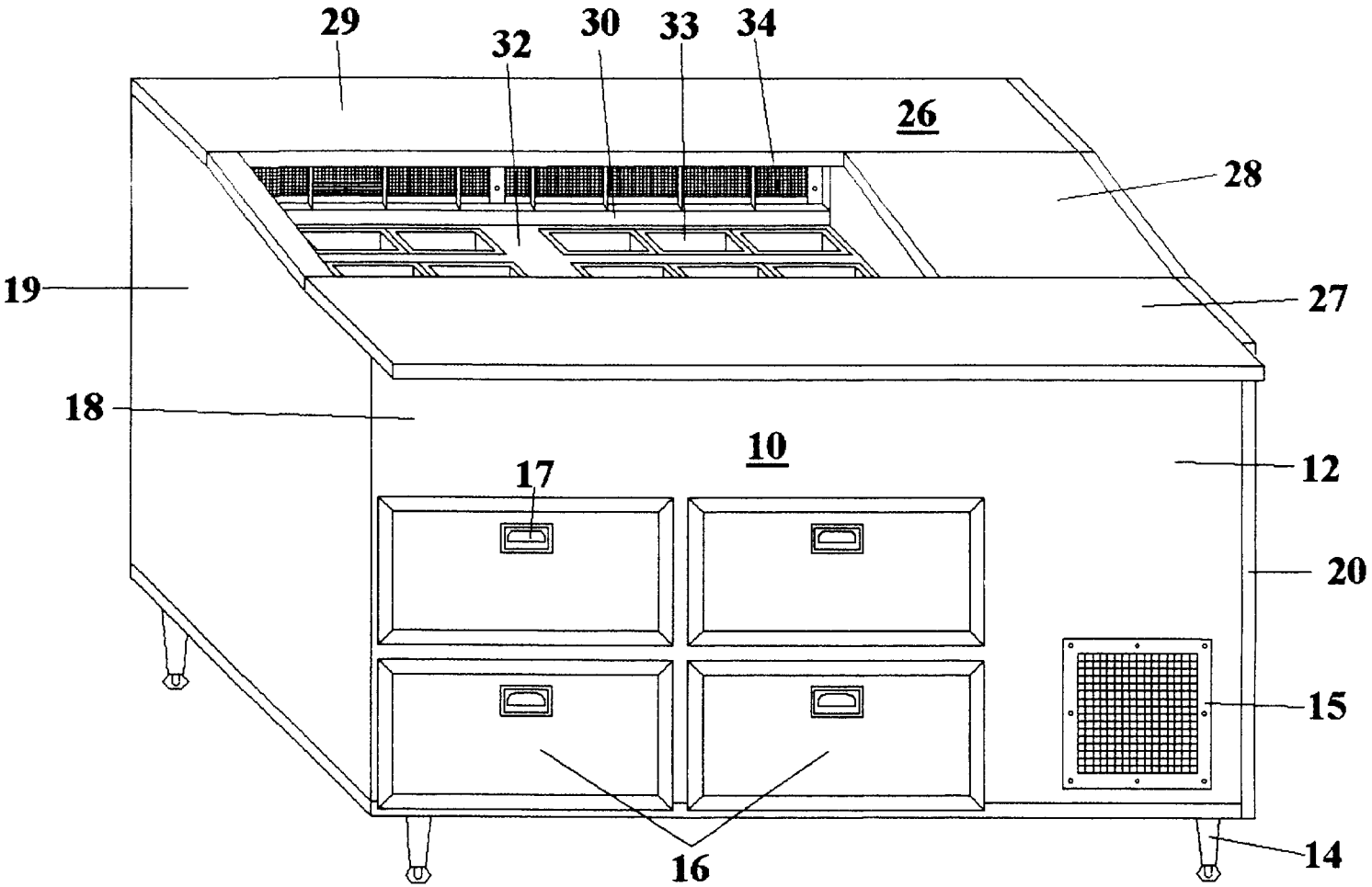
FIG. 1 is a perspective view of a preferred form of food handling cabinet in accordance with the present invention.
Figure 2:
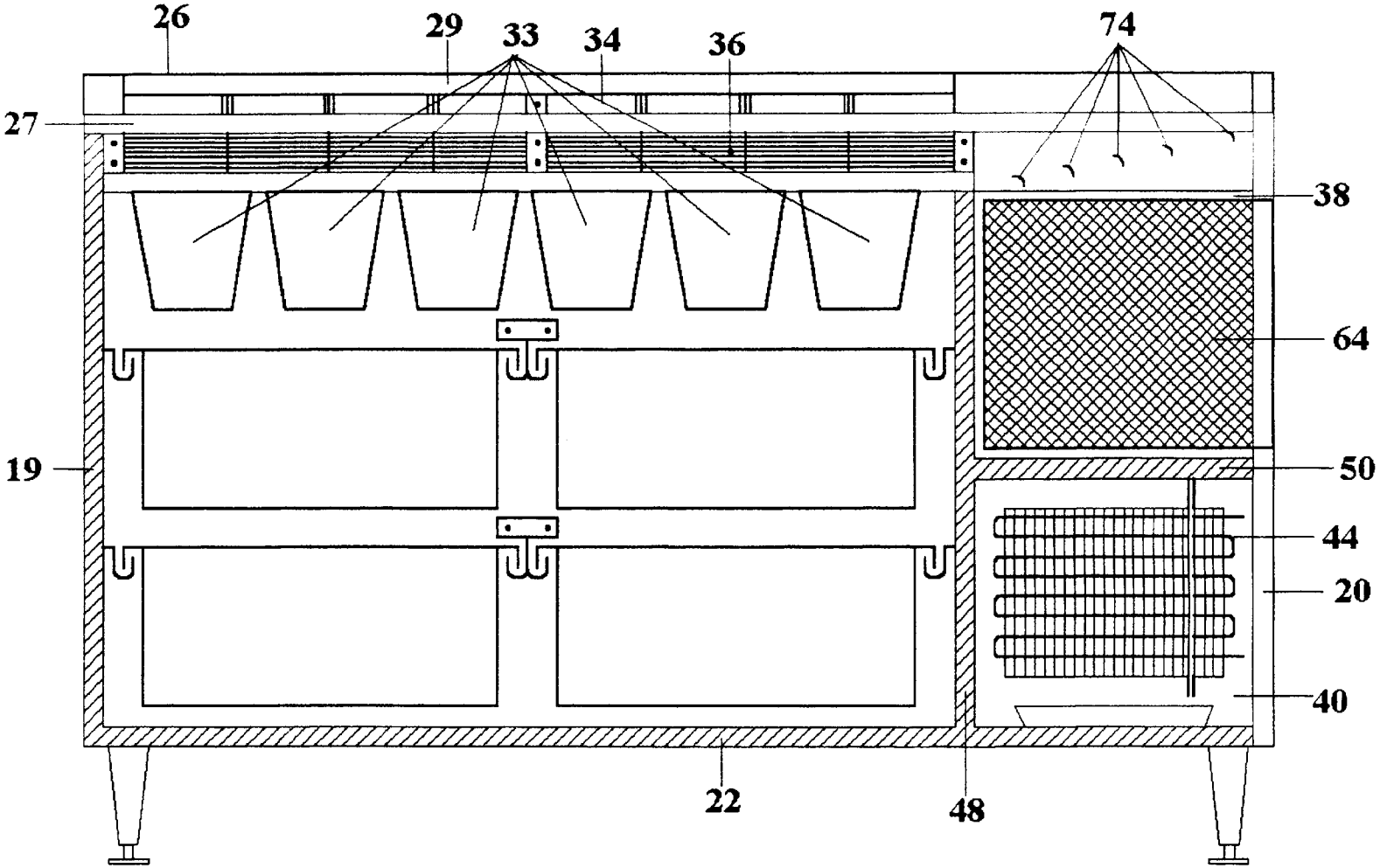
FIG. 2 is a longitudinal sectional view of the food handling cabinet shown in FIG. 1.
Figure 3:
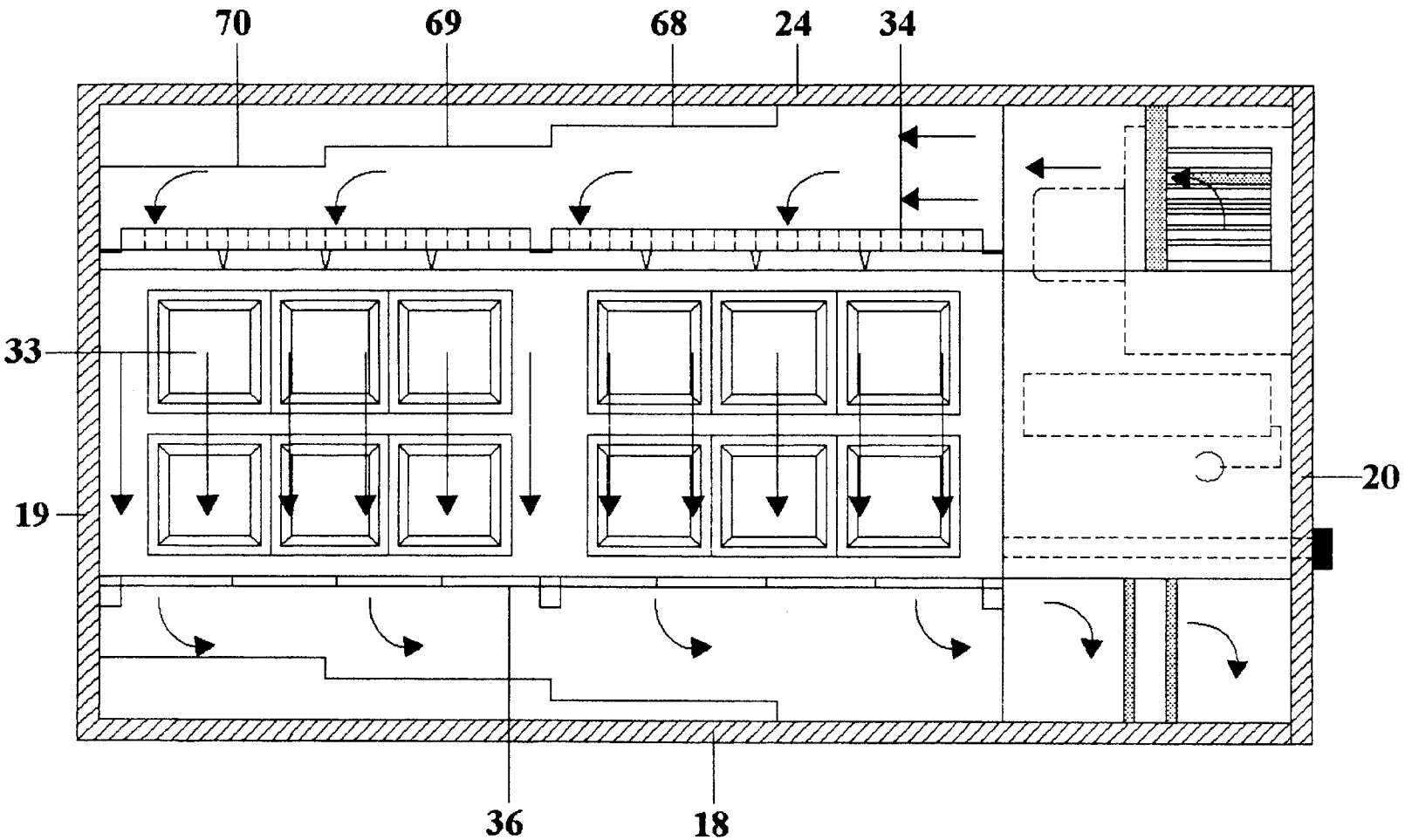
FIG. 3 is a top plan view of the preferred form of food handling table.

Referring in more detail to the drawings, there is shown in FIGS. 1 to 6 a preferred form of refrigeration cabinet 10 having an oblong housing 12 resting on four support legs 14 and provided with pull-out drawers 16 which extend into the hollow interior of the housing 12 from front wall 18. In addition, a hot air discharge grille 20 is positioned in the front wall.

As to the cabinet construction, in addition to the front wall 18, it is comprised of opposite end walls 19 and 20, a bottom wall or base 22 and rear wall 24. A top wall 26 includes a front extension portion with ledge or overhang 27 and end panel 28 together with a rear panel 29 with a central elongated opening 30 between the front and rear panels 27, 29 which extends for the greater length of the cabinet. Spaced below the top wall 26 in the center opening 30 is a horizontal partition wall 32 provided with a series of openings for insertion of food containers 33 therein. A vertical supply air grille 34 extends lengthwise of the opening immediately beneath the rear panel 29, as shown in FIG. 1, and a vertical return air grille 36 extends lengthwise in spaced confronting relation to the grille 34 immediately beneath the front extension panel 27 of the top wall. As best seen from FIG. 6, the supply air grille 34 extends somewhat higher than the return air grille 36 and the end panel 28 slopes downwardly from the rear panel 29 into the front panel 27 so as to afford ease of access for the food handler in removing different food selections from the containers 33 and to compensate for the effect of gravity on the air flow. In the embodiment shown, there are two rows of food containers that fit into the openings of the partition wall 32 and are uniformly spaced from each other both between rows and between adjacent containers in each row. Each of the food containers 33 is typically in the form of a deep-walled pan commonly referred to as an insert for steam tables, although it will be readily apparent that the inserts can be of varying depth. Also, the inserts have a slight ledge or lip around the upper open ends to support them in the openings. Typically, the pull-out drawers 16 are much larger and deeper than the inserts 33 and are provided with drawer pulls 17 to facilitate their insertion and removal into and out of the cabinet. The drawers are particularly intended for storage of additional perishable foodstuffs in order to facilitate refilling of the upper inserts 33.

Figure 4:
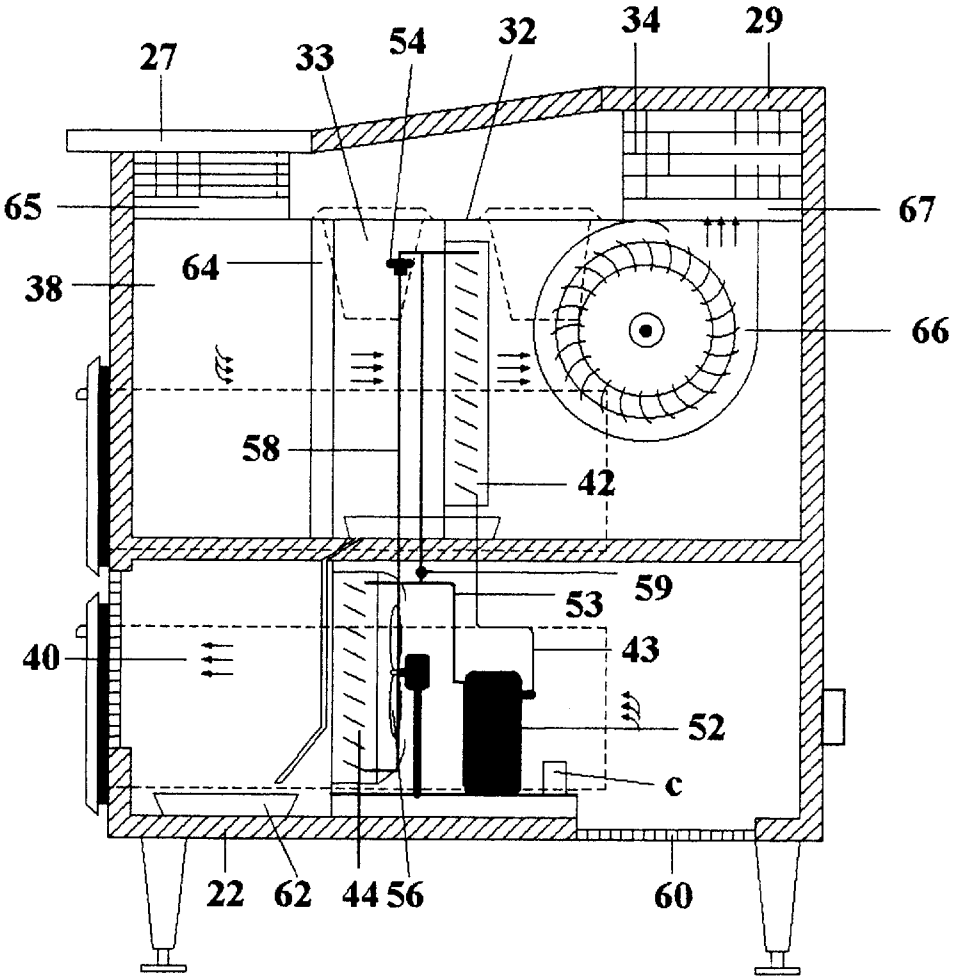
FIG. 4 is an end view partially in section through the preferred form of food handling table.

As shown in FIG. 4, the one end of the cabinet 10 having the end wall 20 is constructed with upper and lower chambers 38 and 40 for an evaporator 42 and condensor 44, respectively, the chambers being defined by a vertical wall panel 48 spaced inwardly within the cabinet from the end wall 20 and a horizontal wall panel 50 extending between the panel 48 and end wall 20. It should be pointed out that all of the cabinet walls as well as the panels may be constructed of wood or metal with an insulating layer, such as, a plastic foam liner.

As further seen from FIG. 4, in the preferred form, the refrigeration apparatus is a mechanical vapor-compression system in which refrigerant is recirculated through a closed cycle between a compressor 52, the condensor 44 and evaporator 38 along with a thermostatic expansion valve 54. In accordance with well-known practice, the air to be circulated over the food containers 33 is cooled by passing across the evaporator 42, and the vaporized refrigerant in the evaporator 42 is circulated through line 43 into the compressor 52 so as to be compressed and discharged via line 53 into the condensor 44 where it is condensed into a liquid as it transfers heat to the external surroundings within the lower chamber via the condenser coils. A condensor fan 56 causes the air in the lower chamber 44 to pass across the condensor coils and then be discharged through the front grille 15. The refrigerant returns to the evaporator 42 through a line 58 into the expansion valve 54. Air enters the lower chamber or compartment through a fresh air inlet 60 in the bottom wall 22, and suitable controls represented at C are provided to turn the system on and off and for temperature control. An evaporator pan 62 is located directly beneath the condensor and compressor to catch any condensate and which can be evaporated by warm air passing over it. Periodically, the evaporator 42 may be defrosted by means of hot gas through the utilization of a solenoid valve, not shown, which is opened to allow the hot gas to pass through the evaporator 42 to defrost it.

In the upper evaporator compartment 38, return air which passes through the return air grille and communicates with the compartment 38 in a manner to be described is drawn through a filter panel 64 and across the evaporator 42 by a supply air fan 66.

Figure 5:
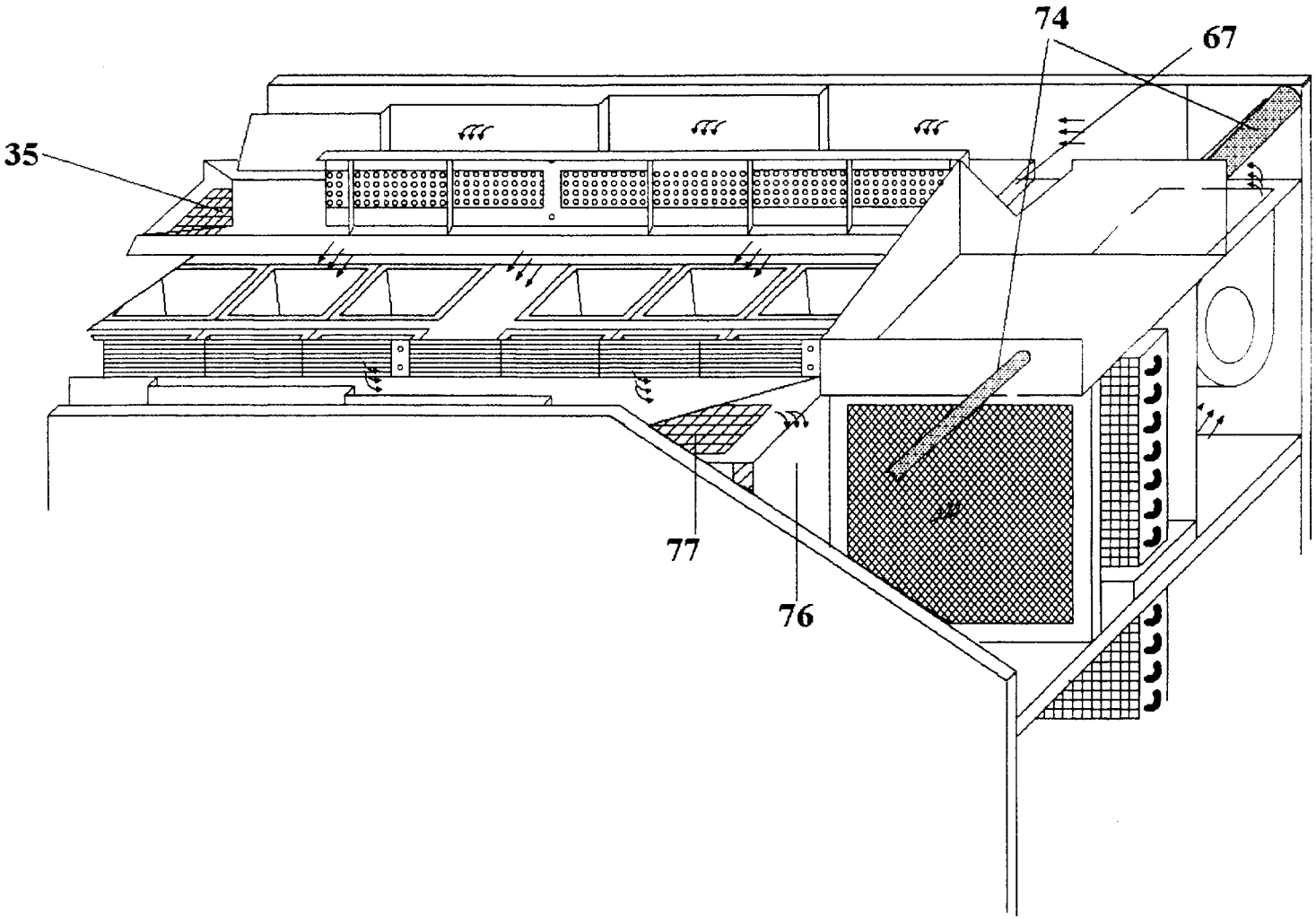
FIG. 5 is a fragmentary isometric view of a portion of the air circulating system.
Figure 6:
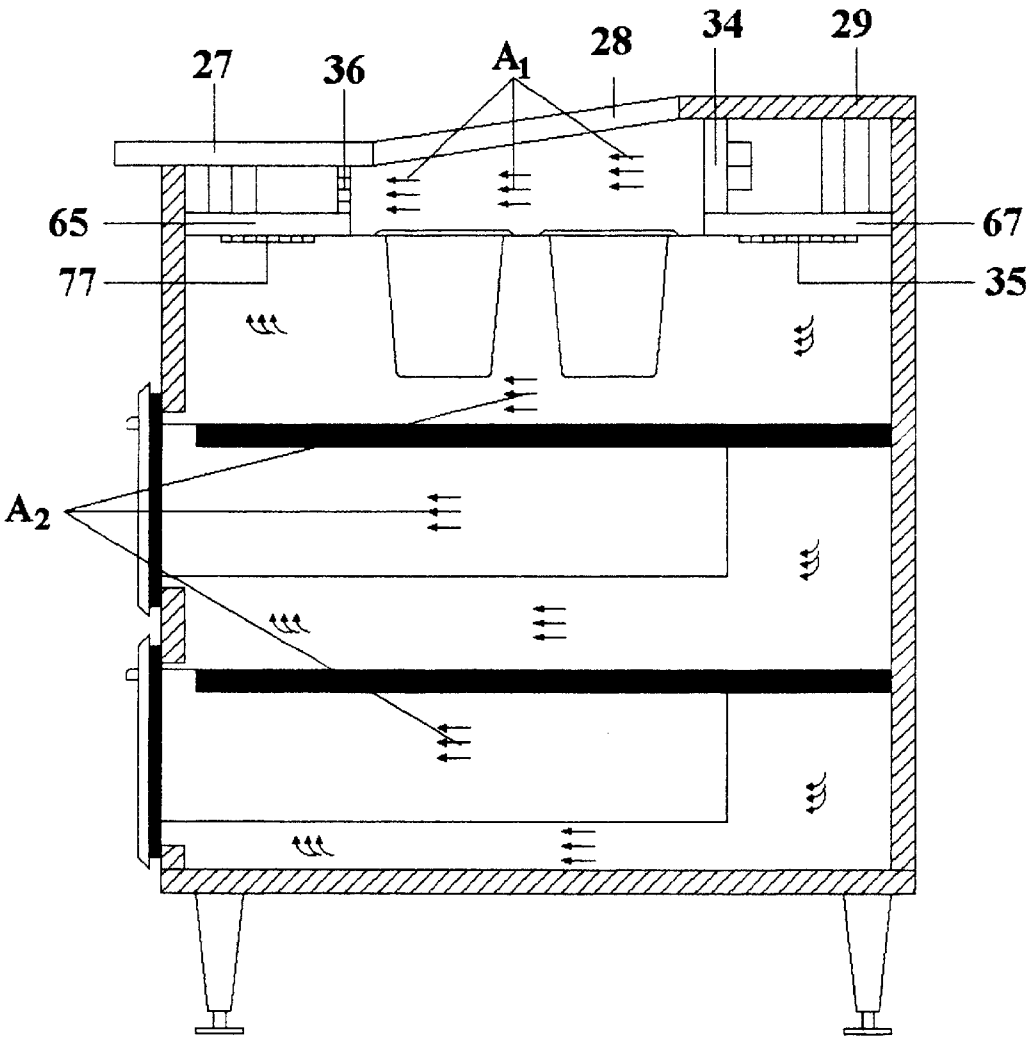
FIG. 6 is a cross-sectional view through the preferred form of food handling table.

An important feature of the present invention resides in controlling the distribution of cooled or conditioned air from the evaporator compartment 38 across the food containers 33. The rear panel 29 is elevated with respect to the front panel 27 to form with the supply air grille 34 a plenum which traverses the length of the food container section. As best seen from FIG. 3, the plenum is of progressively reduced width extending away from the evaporator compartment 38 toward the opposite end wall 19. This is accomplished by stepped wall panel sections 68, 69 and 70 extending vertically between the partition wall 32 and top panel 29. The fan 66 has a discharge duct 67 leading through an opening in the partition wall 32 adjacent to the one end wall 20 for directing the air into the plenum from the evaporator compartment. A plurality of turning vanes 74 extend horizontally across the duct 67 and are arranged diagonally, as best seen from FIG. 2, so that each vane 74 is progressively higher than the preceding vane to promote even distribution of the air flow into the plenum. In turn, the baffle plates or panels 68, 69 and 70 promote even distribution of the air flow horizontally across the entire length of the supply air grille 34. A secondary supply air grille 35 is positioned in the partition wall 32 across the bottom of the plenum to permit some of the incoming air from the fan 66 to be drawn downwardly into the interior space of the cabinet beneath the food containers so that the food containers are cooled by separate air streams. These air streams which pass above and below the food containers 33 as designated at $A_1$ and $A_2$ in FIG. 6, then are combined in the chamber or space 76 just forwardly of the return air grille, the lower air stream $A_2$ passing upwardly through a grille 77 into the space 76. The combined air streams are drawn lengthwise through the space 76, as shown in FIG. 5, and are drawn back through the evaporator compartment for recirculation.

From the foregoing, the cabinet is designed to supply a sanitary, filtered and refrigerated laminar curtain across the upper exposed surfaces of the food containers 33 as well as across the closed or lower end portions of the containers so that the foodstuffs are cooled from both the top and bottom. It will be apparent that the cabinet can be designed more in the form of a box without separate drawer inserts so that, for example, doors (not shown) are positioned in the front wall of the cabinet in place of the drawers.

It is therefore to be understood that the above and other modifications and changes may be made in the construction and arrangement of parts comprising the present invention without departing from the spirit and scope thereof as defined by the appended claims and reasonable equivalents thereof.

I claim:

1. In a refrigerated food handling apparatus provided with a storage compartment for foods and a recessed portion in a top surface having a plurality of food container openings therein for supporting food container inserts above said storage compartment so as to be upwardly open with their bottom portions disposed in open communication with said storage compartment, the improvement comprising:

a supply air duct and return air duct disposed in spaced confronting relation to one another along opposite sides above said food containers in said recessed portions; and a refrigeration system including a condenser, first air flow means for directing outside air across said condenser, a compressor, and an evaporator including second air flow directing means for directing air across said evaporator for discharge simultaneously and in separate layers across upper and lower surfaces of said inserts.

2. In apparatus according to claim 1 wherein said air from said second air flow directing means is directed across the upper surfaces of said food containers from said supply air duct to said return air duct.

3. In apparatus according to claim 2 wherein air from said return air duct is directed into said storage compartment.

4. In apparatus according to claim 3 wherein there are a plurality of storage compartments for supporting food therein.

5. In apparatus according to claim 1 including means isolating said condenser and said first air flow directing means from said storage compartment.

6. In a refrigerated food handling apparatus wherein a cabinet is provided with a storage compartment for foods and a recessed portion in a horizontal top surface has a plurality of openings therein for supporting food container inserts above said storage compartment so as to be upwardly open with their bottom portions disposed in open communication with said storage compartment, the improvement comprising:

a supply air duct and return air duct disposed in spaced confronting relation to one another along opposite sides above said inserts in said recessed portions; and a refrigeration system at an end of said table including a condensor and first air flow means for directing outside air across said condenser, a compressor, and an evaporator including second air flow directing means for directing air across said evaporator for discharge simultaneously and in separate layers across upper and lower surfaces of said inserts.

7. In apparatus according to claim 6 wherein there are a plurality of storage compartments in said cabinet for storing food therein.

8. In apparatus according to claim 6 wherein air from said second air flow directing means is directed across the upper ends of said inserts from said supply air duct to said return air duct, and air from said return air duct is directed across said evaporator.

9. In apparatus according to claim 6 including means isolating said condensor and evaporator from said storage compartment.

10. In apparatus according to claim 6 wherein a plurality of turning vanes are disposed at one end of said supply air duct, and said supply air duct having staggered wall portions for encouraging the flow of air uniformly through said supply air duct.

11. A refrigerated food handling apparatus comprising:

a cabinet having a storage compartment for foods and a recessed portion in a top surface communicating with said storage compartment and defining a plurality of food container openings therein for supporting food container inserts above said storage compartment, said inserts opening upwardly and having bottom portions in communication with said storage compartment;

a supply air duct and return air duct disposed in spaced confronting relation to one another in said top surface and above said inserts, said top surface sloping from said supply air duct downwardly to said return air duct; and a refrigeration system at one end of said table including a condenser and evaporator, first air flow means for directing outside air across said condenser, and second air flow directing means for directing air across said evaporator for discharge simultaneously through said supply air duct and into said storage compartment in separate air streams across said inserts.

12. Apparatus according to claim 11 wherein said supply air duct extends higher than said return air duct.

13. Apparatus according to claim 11 wherein said supply air duct includes a vertical grille for discharge of air across the upper surfaces of said inserts and a lower horizontal grille for discharge of air into said storage compartments.

* * * * *